US006669896B1

(12) United States Patent
Sahlin et al.

(10) Patent No.: US 6,669,896 B1
(45) Date of Patent: Dec. 30, 2003

(54) PURGE PLUG

(75) Inventors: Jan Sahlin, Nacka (SE); Niklas Svanberg, Nacka (SE)

(73) Assignee: Sahlin Gjutteknik AB, Nacka (SE)

( * ) Notice: Subject to any disclaimer, the term of this patent is extended or adjusted under 35 U.S.C. 154(b) by 63 days.

(21) Appl. No.: 10/048,247

(22) PCT Filed: Jul. 20, 2000

(86) PCT No.: PCT/SE00/01508

§ 371 (c)(1),
(2), (4) Date: Jan. 31, 2002

(87) PCT Pub. No.: WO01/08834

PCT Pub. Date: Feb. 8, 2001

(30) Foreign Application Priority Data

Aug. 3, 1999 (SE) ..... 9902830

(51) Int. Cl.[7] ..... B22D 1/00
(52) U.S. Cl. ..... 266/220; 266/217; 222/603
(58) Field of Search ..... 266/220, 217; 222/603

(56) References Cited

U.S. PATENT DOCUMENTS 4,053,147 A * 10/1977 Moser et al. ..... 266/220
4,470,582 A 9/1984 Shaw et al.
5,478,053 A * 12/1995 Richter et al. ..... 266/220

FOREIGN PATENT DOCUMENTS

| | | | |
|---|---|---|---|
| DE | 39 07 887 A1 | | 10/1989 |
| DE | 196 10 578 C1 | | 4/1997 |
| WO | WO 01/83831 | * | 11/2001 |
| WO | WO 01/83832 | * | 11/2001 |

* cited by examiner

*Primary Examiner*—Scott Kastler
(74) *Attorney, Agent, or Firm*—Burns, Doane, Swecker & Mathis, L.L.P.

(57) ABSTRACT

A purge plug adapted to be replaceably attached to the bottom of a lable for purging gas through a heat in the ladle. The purge plug comprises a ceramic body having at least one through gap which extends between the end faces of the body and a casing which encloses the body. The gas is fed to the external end face of the body in order to flow, at a predetermined pressure, through said gap to the internal end face of the body and into the heat. The ceramic body comprises an external, essentially sleeve-shaped body portion and an internal, truncated cone-shaped body portion. Between them said gap is arranged. The internal body portion is movable in relation to the external body portion and is pretensioned by a resilient means in a direction towards the heat to close the gap. A gas supply pipe is connected to a space beneath the external end face to open the gap.

21 Claims, 2 Drawing Sheets

PURGE PLUG

The present invention relates to a purge plug which is adapted to be replaceably attached to the bottom of a ladle for purging gas through a heat in the ladle, the purge plug comprising a ceramic body having at least one through gap which extends between the end faces of the body and a casing which encloses the body, the gas being fed to the external end face of the body in order to flow, at a predetermined pressure, through said gap to the internal end face of the body and into the heat.

Purge plugs are generally used for stirring a heat in a ladle, and, where appropriate, also for modifying the heat, and serve to let gas under high pressure, for instance 6–10 bar, into the ladle. A purge plug traditionally consists of a gas-permeable, ceramic cone having the shape of a truncated cone of about 10 kg which is enclosed by a sheet-metal casing. The purge plug is generally supplied in so-called sets, that is the cone is mounted in a hollow block which weighs about 50 kg.

The purge plug has a key role when manufacturing pure steel and is used by practically all steel plants in the world. One or more purge plugs are replaceably mounted in the bottom of a unit which is found in all steel plants and is called a ladle, that is a container lined with refractory material and adapted to contain melted steel. In the ladle, various high-temperature chemical processes are carried out in which the purge plug is crucial. Gas, generally argon, is purged through the purge plug. The purge plug is worn heavily during the process in its uppermost portion, which is directed towards the heat, and regularly has to be replaced by a new purge plug when its height has shrunk to a minimum permissible level.

The first purge plugs which were made were porous, that is they were gas-permeable but did not let steel through. The disadvantage of these purge plugs was that high pressure gas was required to obtain a sufficient flow, and owing to their porosity the wear was considerable.

The next step in the development of purge plugs was so-called directional porosity, that is a number of ducts with a diameter of about 0.5 mm were formed by casting and gas was purged through the ducts. The advantage of this purge plug was that it was easy to achieve a gas flow through the plug and that the plug could be made compact, which meant less wear. The disadvantage was a greater risk of infiltration of steel in the ducts, which obstructed the purge plug.

The third step in the development of purge plugs was to form slots or gaps by casting, having a thickness of about 0.2 mm and a length of about 20 mm, through the purge plug instead of ducts. The advantage of this was that it was easy to achieve a high gas flow, without infiltration of steel in the slots. However, there is always a risk of infiltration of steel as long as there are open gaps in the purge plug.

A purge plug must fulfil three requirements: a high degree of durability, satisfactory gas permeability and avoidance of infiltration of steel in the gaps of the purge plug.

Satisfactory durability is obtained by the purge plug being made of a high-quality, compact refractory material.

A high degree of gas permeability is obtained by the gaps having a sufficient sectional area.

Minimum infiltration is obtained by the gaps being sufficiently narrow.

These three requirements counteract one another and a purge plug is a compromise of these three properties.

German patent specification DE 196 10578 discloses a purge plug which comprises an external body having a truncated cone-shaped cavity in its upper portion, a cylindrical, enlarged cavity in an intermediate portion and a cylindrical duct in its lower portion. The cavities communicate with one another to allow gas with a specific pressure flow from one end face to another. In the cavities, in the above-mentioned order, a truncated cone, a piston and a tubular piston rod which is provided with openings are movably arranged as a unit. The cone is pretensioned to a closing position by means of an external pressure spring which engages with the free piston rod end protruding from the purge plug. When gas with a sufficient pressure (in order to counteract the force of the spring and the metallurgical pressure) is supplied through a gas supply pipe and via the piston rod to the enlarged cavity, the piston raises the cone and the gap between the cone-shaped cavity and the cone is opened. Then the gas can flow round the piston and through the gap into the heat.

The disadvantages of this construction are as follows:

The construction is very difficult to manufacture as purge plugs are generally cast in a refractory material. It is technically difficult to make an intermediate, enlarged cavity (16) by casting since the template used in casting is very difficult to remove.

The construction has complicated protruding parts (the spring suspension beneath the purge plug), which are inconvenient in a steelworks environment since they may easily break by being subjected to impacts or other rough handling.

The spring suspension is expensive to manufacture.

The purge plug is worn gradually. When it is worn down to the enlarged cavity (16), a breaking through of the plug is obtained and steel flows through the bottom of the ladle with disastrous results. It is thus very important that the plug not be worn down to this level. Advanced equipment is required in order to determine how far down the purge plug has been worn.

Another patent that is based on a purge plug having a movable body and a fixed body, where the gas flows through an annular gap, is U.S. Pat. No. 4,470,582.

What mainly makes this construction different from that in the above-mentioned German patent is that the pressure spring has been replaced by a lever mechanism which is preloaded by means of a hydraulic cylinder.

The disadvantages of this construction are as follows:

Because of its complicated shape, it is very expensive to manufacture.

The gas flow is controlled by an external valve which opens and closes the annular gap by guiding the movable body upwards and downwards, respectively. The disadvantage is that an external controlling device is required, which takes up space and is inconvenient in a steelworks environment. It can easily be damaged by external forces.

As in the above-mentioned German patent, the purge plug is worn with the same result as indicated above.

One object of the present invention is to provide a purge plug having a gap, the width of which is a function of the applied gas pressure and which is easy and inexpensive to manufacture.

Another object of the invention is to provide a purge plug having an adjustable gap which does not require complicated mechanisms and does not exhibit any protruding components.

Yet another object is to provide a reliable purge plug which can be worn down more or less completely before the breaking through takes place.

According to the invention these objects are achieved by a purge plug as mentioned by way of introduction, which is characterised in that the ceramic body comprises an external essentially sleeve-shaped body portion and an internal, truncated cone-shaped body portion between which said gap is arranged, that the internal body portion is movable in relation to the external body portion and is pretensioned by means of a resilient means in a direction towards the heat for closing the gap and that a gas supply pipe is connected to a space beneath the external end face in order to open the gap.

Further developments of the invention are evident from the features indicated in the subclaims.

BRIEF DESCRIPTION OF THE DRAWINGS

A preferred embodiment of the invention will now be described by way of example with reference to the accompanying drawings, in which.

Figure 1:
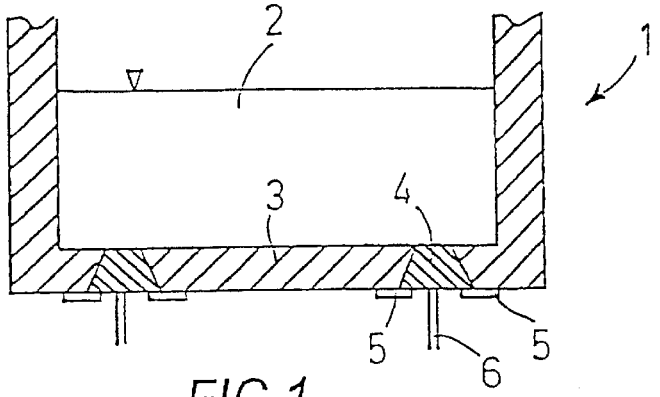
FIG. 1 is a schematic elevational cross-sectional view of the bottom of a ladle with purge plugs.

Reference is first made to FIG. 1, which schematically illustrates the bottom portion of a ladle 1 for a heat 2, usually a heat of metal, such as steel. A number of replaceable purge plugs 4 are, in conventional manner, releasably mounted to the bottom 3 of the ladle by means of per se known mounting means, as indicated by the reference numeral 5. A gas supply pipe 6 is connected to each purge plug 4. All this is prior-art technique and, thus, does not require any further explanation.

Figure 3:
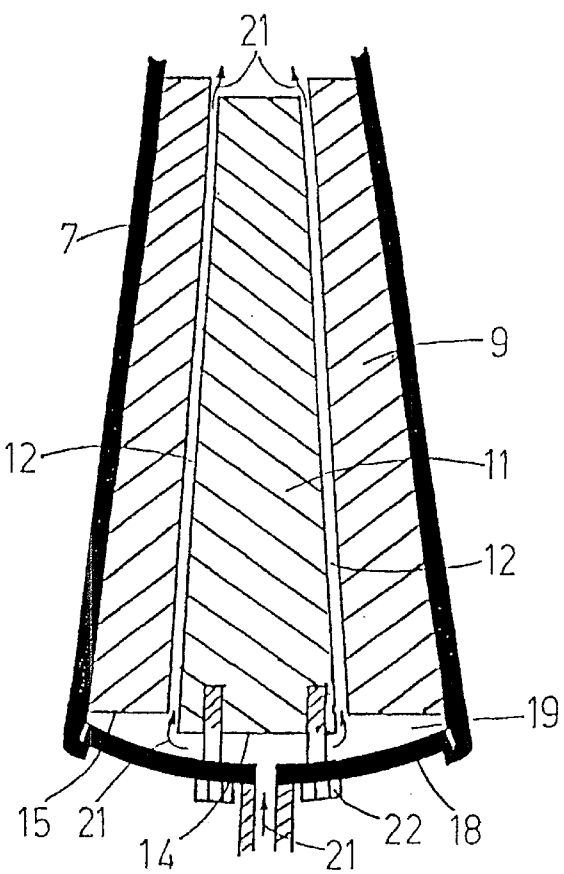
FIG. 3 shows the purge plug according to FIG. 2 having an open gas flow gap.
Figure 2:
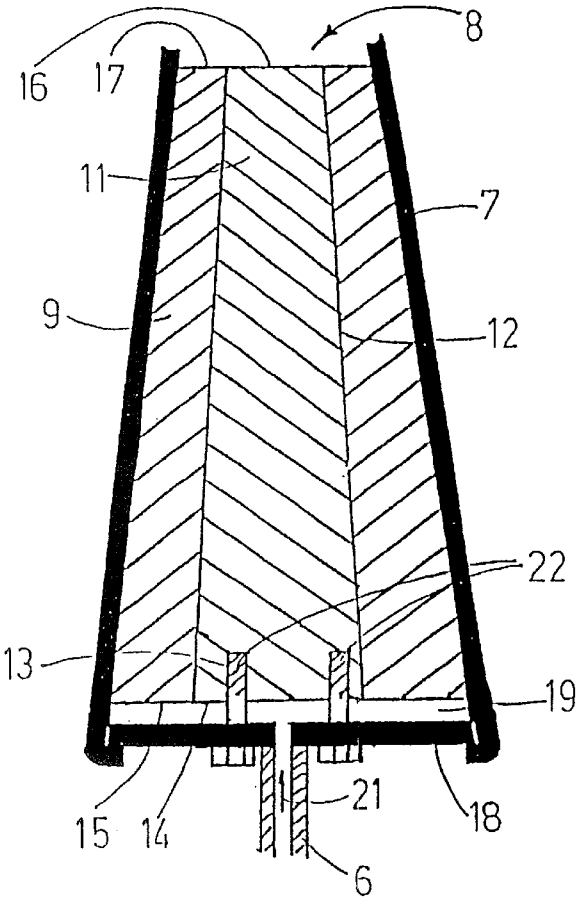
FIG. 2 is an elevational cross-sectional view of a purge plug according to the invention having a closed gas flow gap.

Reference is now made to FIGS. 2 and 3, in which the construction and function of the purge plug according to the invention are shown. The purge plug 4 comprises a casing 7. Since the purge plug 4 is to be used for a steel heat 2, the casing 7 is preferably made of steel. The casing is shown with the shape of a truncated cone, the tapered end being in contact with the heat, see FIG. 1, but it may also be inverted or cylindrical (not shown). A ceramic body 8 is enclosed by the casing 7 and is preferably attached to the casing 7 along its whole length. Preferably, the body 8 is cast directly inside the casing.

The body 8 is, in its turn, divided into an external, concentric, essentially sleeve-shaped body portion 9 having a truncated cone-shaped internal cavity and an internal, truncated cone-shaped body portion 11 which completely fills up the cavity. The internal body portion 11 is movable, that is longitudinally displaceable, in relation to the external body portion 9, with a gap 12 appearing between them. When manufacturing the body portions 9 and 11, the internal body portion 11 can be easily formed, well adapted to the external body portion 9, by placing a plastic foil or plastic sheet which has been pre-formed to a truncated cone-shaped casing element concentrically in the casing 7 at the moment of casting and then removing it when the refractory material (the ceramic compound) has solidified. Furthermore, in connection with the casting, threaded blind holes 13 can be formed or threaded sleeve inserts be cast into the larger end face 14 of the internal body portion 11.

Preferably, but not necessarily, the larger end face 15 of the external body portion 9 is on a level with the above-mentioned end face 14. The same goes for the smaller end faces 16 and 17, respectively, of the body portions 9 and 11.

The internal body portion 11 is displaceable downwards relative to the fixed external body portion 9 (see FIG. 2) and is pretensioned upwards to close the gap 12 by means of a resilient or elastic means which acts against the end face 14.

In the preferred embodiment a resilient bottom plate 18 is gas-impermeably attached to the casing 7 at a distance from the external end face of the body 8, in this case the end faces 14 and 15, a space or chamber 19, which can be pressurised, being defined between them. This distance can be small and even non-existent within limited areas of the end faces 14 and 15—the only condition being that a chamber 19 is formed when pressurised fluid (purging gas) is supplied. A gas supply pipe 6 is connected to the bottom plate 18 and is connected to the chamber 19 for pressurisation of the same with the purging gas 21. The internal body portion 11 is fixedly attached to the bottom plate 18, for instance, by means of bolts 22 or some other suitable attaching means. The gap 12 is kept closed by the internal body portion 11 being pressed upwards in FIG. 2 into abutment against the internal peripheral surface of the external body portion 9 by means of the pretensioning of the bottom plate 18 and/or the pressure of the purging gas.

When it is desirable to purge gas through the heat in the ladle, gas is supplied under high pressure to the space 19. Since the bottom surface or end face 15 of the external body portion 9 is larger than the bottom surface or end face 14 of the internal body portion 11, the bottom plate 18 is caused to bend outwards, see FIG. 3, and pulls along the internal body portion 11, whereby the annular gap 12 is opened and the gas can flow into the heat. The more pressure one applies, the more the gap opens. When the gas flow is stopped or the pressure of the gas is decreasing, the bottom plate 18 springs back and pushes the internal body 11 back and closes the gap completely. This prevents infiltration of the heat into the gap 12. The construction of this new purge plug means that it is possible to obtain an almost unlimited gas flow without having any infiltration of steel into the gap in the purge plug. This is achieved by the size of the gap varying with the applied pressure.

Figure 4:
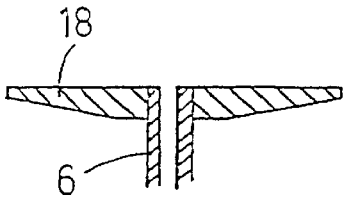
FIG. 4, FIG. 5 and FIG. 6 illustrate various embodiments of the bottom plate of the purge plug.
Figure 5:
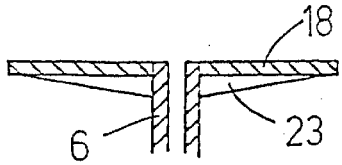

In FIGS. 2 and 3, the bottom plate 18 is shown to have a constant thickness. However, it is of course possible to control the function of the pressure of the gas on the gap width by using bottom plates 18 with specific resilience properties. Apart from using bottom plates of various thicknesses for this aim, it is possible to achieve the desired spring properties by giving the bottom plate a thickness that is not even, that is having its thickness varying in a direction away from its circumference towards its centre. An example of this has been illustrated in FIG. 4. As shown in FIG. 5, it is also possible to obtain the required resilience properties by providing a bottom plate of uniform thickness with stiffening flanges or ribs 23 which are attached perpendicular to the bottom plate, preferably radially oriented on the bottom plate, and exhibiting a non-constant height or thickness. Naturally, the above-mentioned features can also be combined in order to achieve the desired function, that is the width of the gap 12 at different specific gas pressure.

Figure 6:
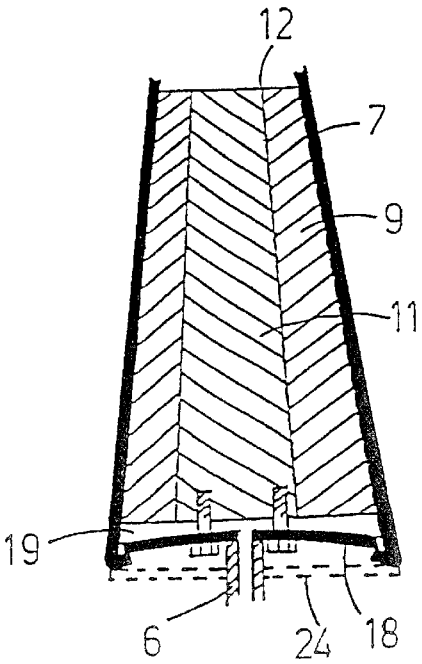

A different way to obtain the desired resilience properties of the bottom plate, which is also compatible with those mentioned above, is to make the bottom plate 18 curved, for instance inwards, as shown in FIG. 6. For this purpose, it is also possible to make the bottom plate undulated (not shown).

In order to limit the deflection of the bottom plate, for instance at extremely high gas pressure or when the width of the gap is not allowed to exceed a certain dimension, for example 0.5 mm, it is suitable to supply the purge plug with a deflection-limiting means, for instance one or more girder elements 24 indicated by dashed lines in FIG. 6. Each girder element 24 is fixedly attached to the casing 7 (see FIG. 6) and/or is secured to the external body portion 9 (not shown). The above-mentioned means can, of course, also be a thick, essentially rigid plate, cf. the bottom plate of a conventional purge plug. When required, connecting elements may be used between the outermost portion of the casing and the ends of the deflection-limiting means (not shown). When a deflection-limiting means as described above is used, it may, in certain cases, be suitable to arrange yet another resilient means between said means 24 and the bottom plate 18 (not shown).

The circumferential surface of the internal body portion 11 and the internal circumferential surface of the external body portion 9 define, according to that mentioned above, the shape of the gap 12. Usually, it is preferred that the cross-sectional profile of the gap, that is the shape of the gap in a plane perpendicular to the longitudinal axis of the purge plug (a plane which is parallel to the bottom plate) is a circle or an oval. However, the cross-sectional profile of the gap is totally optional, such as a triangle, square or polygon, or star-shaped since the two body portions 9 and 11 can be cast at the same time, having between them a separating casing element of plastic foil or plastic sheet with a chosen cross-sectional profile, which, after the solidification of the compound, can be easily removed.

Figure 7:
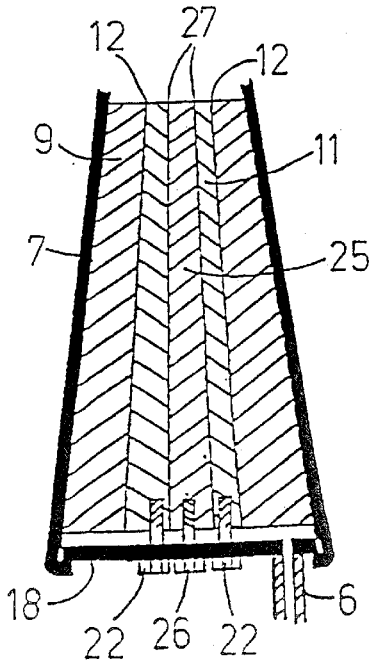
FIG. 7 shows an alternative embodiment of the purge plug according to the invention.

In order to obtain special gas flow properties, for instance precipitate changes in the gas flow through the purge plug, it is further possible to form the internal body portion 11 with a truncated cone-shaped cavity, in which a correspondingly formed truncated cone-shaped innermost body portion 25 is displaceably arranged, see FIG. 7. This innermost body portion 25 works in the same way as described in connection with the internal body portion 11 since the former is also fixedly attached to the bottom plate 18, for example by means of a bolt 26. The resilience properties of the bottom plate is accordingly adjusted by means of the modifications described above, cf. FIGS. 4 and 5. The gap 27 between the innermost body portion 25 and the internal body portion 11 may be given an optional shape in accordance with that described above and, preferably, the gap 27 is formed in the same manner as the gap 12, that is by means of yet another casing element which is arranged concentrically with the above described casing element in the casing 7.

It should be noted that every movable body portion 11, 25 tapers off upwards, that is from the external end face 14, 15 towards the internal end face 16, 17 adjacent to the heat in the shown embodiments of the purge plug according to the invention.

The following properties are achieved by means of the purge plug according to the invention:

It can easily be manufactured (as inexpensive as the purge plugs which are available on the market today).

Infiltration is completely avoided.

The ratio pressure/flow may be adapted to the conditions of the respective users.

An unlimited gas flow can be obtained.

The invention is not limited to that described above or that shown in the drawings but can be changed within the scope of the appended claims.

What is claimed is:

1. A purge plug which is adapted to be replaceably attached to the bottom of a ladle for purging gas through a heat in the ladle, the purge plug comprising:

a ceramic body having at least one through gap which extends between an internal end face and an external end face of the body;

a casing which encloses the body;

the ceramic body comprises an external sleeve-shaped body portion defining the through gap, and an internal, truncated conical body portion movably disposed inside the through gap and being adapted to define a gap with walls of the through gap, the internal body portion being pretensioned by a resilient member in a direction towards the heat to close the gap; and a gas supply pipe connected to a space beneath the external end face of the body through which gas is adapted to be supplied under pressure to overcome a force of the resilient member and open the gap.

2. A purge plug as claimed in claim 1, wherein the resilient member includes a resilient bottom plate gas-impermeably attached to the casing at a distance from the external end face of the body the space being at least partially defined by the casing, the external end face, and the bottom plate, the internal body portion being attached to the bottom plate.

3. A purge plug as claimed in claim 2, wherein the thickness of the bottom plate varies in a direction from its circumference towards its center.

4. A purge plug as claimed in claim 2, wherein the bottom plate is provided with radially oriented stiffening flanges.

5. A purge plug as claimed in claim 2, wherein the bottom plate is curved.

6. A purge plug as claimed in claim 1, wherein a cross-sectional profile of the gap is a circle or an oval.

7. A purge plug as claimed in claim 1, wherein a cross-sectional profile of the gap is a triangle, square or polygon.

8. A purge plug as claimed in claim 2, wherein means for limiting deflection of the bottom plate is arranged outside the space at a distance from the bottom plate and is attached to at least one of the external body portion and the casing.

9. A purge plug as claimed in claim 8, wherein the limiting means is a girder element having ends of which are fixedly attached to the casing.

10. A purge plug as claimed in claim 8, wherein additional resilient member is arranged between the bottom plate and the limiting means.

11. A purge plug as claimed in claim 3, wherein the bottom plate is provided with radially oriented stiffening flanges.

12. A purge plug as claimed in claim 3, wherein the bottom plate is curved.

13. A purge plug as claimed in claim 4, wherein the bottom plate is curved.

14. A purge plug as claimed in claim 2, wherein a cross-sectional profile of the gap is a circle or an oval.

15. A purge plug as claimed in claim 3, wherein a cross-sectional profile of the gap is a circle or an oval.

16. A purge plug as claimed in claim 4, wherein a cross-sectional profile of the gap is a circle or an oval.

17. A purge plug as claimed in claim 5, wherein a cross-sectional profile of the gap is a circle or an oval.

18. A purge plug as claimed in claim 2, wherein a cross-sectional profile of the gap is a triangle, square or polygon.

19. A purge plug as claimed in claim 3, wherein means for limiting deflection of the bottom plate is arranged outside the space at a distance from the bottom plate and is attached to at least one of the external body portion and the casing.

20. A purge plug as claimed in claim 9, wherein additional resilient member is arranged between the bottom plate and the limiting means.

21. A purge plug as claimed in claim 1, wherein the resilient member includes resilient means.

* * * * *